United States Patent [19]

Ishii et al.

[11] Patent Number: 5,063,635

[45] Date of Patent: Nov. 12, 1991

[54] SUCTION HEAD FOR ATTACHMENT TO A VACUUM CLEANER

[75] Inventors: Mitsuo Ishii; Yoshitaka Murata, both of Shiga, Japan

[73] Assignee: Matsushita Electric Industrial Co., Ltd., Osaka, Japan

[21] Appl. No.: 519,614

[22] Filed: May 7, 1990

[30] Foreign Application Priority Data

| | | | |
|---|---|---|---|
| May 8, 1989 | [JP] | Japan | 1-114714 |
| Jun. 14, 1989 | [JP] | Japan | 1-151765 |
| Aug. 18, 1989 | [JP] | Japan | 1-213396 |
| Jan. 12, 1990 | [JP] | Japan | 2-5012 |
| Jan. 17, 1990 | [JP] | Japan | 2-7408 |

[51] Int. Cl.[5] ..... A47L 9/06

[52] U.S. Cl. ..... 15/398; 15/393; 15/420

[58] Field of Search ..... 15/398, 399, 400, 420, 15/393

[56] References Cited

U.S. PATENT DOCUMENTS

| | | | |
|---|---|---|---|
| 983,971 | 2/1911 | Baker | 15/393 |
| 993,772 | 5/1911 | Goughnour | 15/393 |
| 1,068,713 | 7/1913 | Thurman | 15/393 |
| 1,657,111 | 1/1928 | Desnoyers | 15/400 X |
| 2,241,775 | 5/1941 | Forsberg | 15/398 |
| 3,745,605 | 7/1973 | Gitschel | 15/400 |
| 3,820,189 | 6/1974 | Roth | 15/400 |

FOREIGN PATENT DOCUMENTS

| | | |
|---|---|---|
| 1503830 | 7/1969 | Fed. Rep. of Germany . |
| 2024616 | 8/1971 | Fed. Rep. of Germany . |
| 2309137 | 8/1974 | Fed. Rep. of Germany . |
| 3025977 | 11/1982 | Fed. Rep. of Germany . |
| 842524 | 6/1939 | France . |
| 1484856 | 5/1966 | France . |
| 55-10967 | 1/1980 | Japan . |
| 1569098 | 6/1980 | United Kingdom . |
| 2109224 | 6/1983 | United Kingdom . |
| 2150014 | 6/1985 | United Kingdom . |

*Primary Examiner*—Chris K. Moore

*Attorney, Agent, or Firm*—Panitch Schwarze Jacobs & Nadel

[57] ABSTRACT

A suction head for attachment to a vacuum cleaner, the suction head including a first portion and a second portion, the second portion having a suction port and a bank on the peripheral of the suction port, and a woven cloth disposed on the bank, the woven cloth having cut piles which constitute a brush.

2 Claims, 13 Drawing Sheets

38
S
35

43
44
40
41
51
47
48
50
42
45
53
48
50
51
47

55
56
57
58
59
60
61
62
63
64
65
66
67
68
Y
E

SUCTION HEAD FOR ATTACHMENT TO A VACUUM CLEANER

BACKGROUND OF THE INVENTION

1. Field of the Invention

The present invention relates generally to a vacuum cleaner, and more particularly to a suction head for attachment to the vacuum cleaner, the suction head being applicable not only to hard objects such as wooden floors but also to soft objects such as carpets.

2. Description of the Prior Art

There are various types of known suction heads attached to vacuum cleaners wherein the suction heads are provided with a height adjustment lever such as a pedal for directing the suction nozzle to either a hard object or a soft object as desired.

A typical example disclosed in Japanese Laid-open Patent Publication (Kokai) No. 55-10967 will be explained by reference to FIG. 20. When the cleaner is applied to a hard object such as a wooden floor, the brush 1*a* is projected beyond a suction head 2*a* by means of a pedal. In this way the suction head 2*a* is raised above the floor surface by raising the brush 1*a* and roller 3*a*. The distance between the floor surface and the suction port of the suction head 2*a* is roughly 1.0 mm. This small gap protects the floor surface against becoming scratched by fine dirt such as sand trapped in the bristles.

FIG. 21 shows another example in which a suction head 4*a* is provided with bristles 5*a* extending from the suction port. The bristles 5*a* are made of nylon threads each having a diameter of about 0.15 mm. This type of vacuum cleaner is adapted for cleaning a hard object such as wooden floor and mat (especially Japanese "tatami" mats, which are made of fragile straw and rush). In cleaning "tatami", special care should be paid not to scratch it.

When the Japanese mat ("tatami") is cleaned, the problem is that the woven straws and rush are liable to break by friction caused by the bristles of the brush.

The known cleaners mentioned above have a disadvantage in that the bristles of the brushes scratches the wooden floor panels, sometimes damaging them seriously. Waxed floor panels are especially susceptible to scratches. In addition, the scratchy texture of the floor or carpet is unpleasant for the sweeper, and causes the roller to be noisy. In the case of the Japanese "tatami" mats, the damage becomes more serious.

In order to solve the problems resulting from the bristles of the brushes, soft brushes of fine threads have been proposed. The soft brushes have solved some of the problems but a new problem has arisen. Soft brushes are so pliable that the bristles retain fine particles like food scraps and prevent the particles from entering the dust bag of the cleaner. These fine particles including dirt and food scraps become a breeding ground for germs and ticks. This is unsanitary.

SUMMARY OF THE INVENTION

The suction head of the present invention, which overcomes the above-discussed and numerous other disadvantages and deficiencies of the prior art, comprises a first portion and a second portion, the second portion comprising a suction port including a ridge on its periphery, and a woven cloth having cut piles, the woven cloth being disposed on the ridge, the cut piles constituting a brush upright on the bank.

In a preferred embodiment, the ridge comprises a front side and a rear side with respect to the suction port, and the woven cloth is disposed on each side of the ridge, wherein the brush on the front side of the suction port comprises a plurality of portions spaced by a first air passage, and the brush portions on the front side and the rear side of the suction port are spaced by a second air passage extending perpendicularly to a direction in which air is induced into the suction head.

In another preferred embodiment, the cut piles are bundled at their root portions, and wherein the bundled root portions are arranged with different pitches in the vertical direction and the horizontal direction with respect to the suction port.

In a further preferred embodiment, the bundled root portions of the cut piles are arranged with larger pitches in the direction perpendicular to the air inducing direction than with those in the air inducing direction, thereby producing air passages between adjacent bundled root portions of the piles.

In a still further embodiment, the bundled root portions of the cut piles are angled in the same direction with respect to the extended width of the second portion of the suction head.

In another preferred embodiment the suction head further comprises means for supporting the woven cloth, and the woven cloth comprises a first use woven cloth and a second use woven cloth disposed in a replaceable manner.

In a further embodiment, the supporting means is a polygonal bar, and the first use woven cloth is disposed on one side of the polygonal bar, and the second use woven cloth is disposed on the other sides thereof.

In a preferred embodiment, the woven cloth is treated with moth proofing and is sterilized.

In another embodiment, the suction head further comprises a cloth member woven with weft and warp both treated with a moth proofing and a sterilizing agent.

Thus, the invention described herein makes possible the objectives of (1) providing a suction head for attachment for a vacuum cleaner, the suction head capable of cleaning not only hard surfaces but also soft surfaces without scratching them or causing unpleasant noise or scratchy texture, and (2) providing a suction head having the possibility of providing no breeding ground for germs and ticks in the brush by securing the smooth passage of air therethrough.

BRIEF DESCRIPTION OF THE DRAWINGS

The present invention may be better understood and it numerous objects and advantages will become apparent to those skilled in the art by reference to the accompanying drawings as follows.

DETAILED DESCRIPTION OF THE INVENTION

Figure 1:
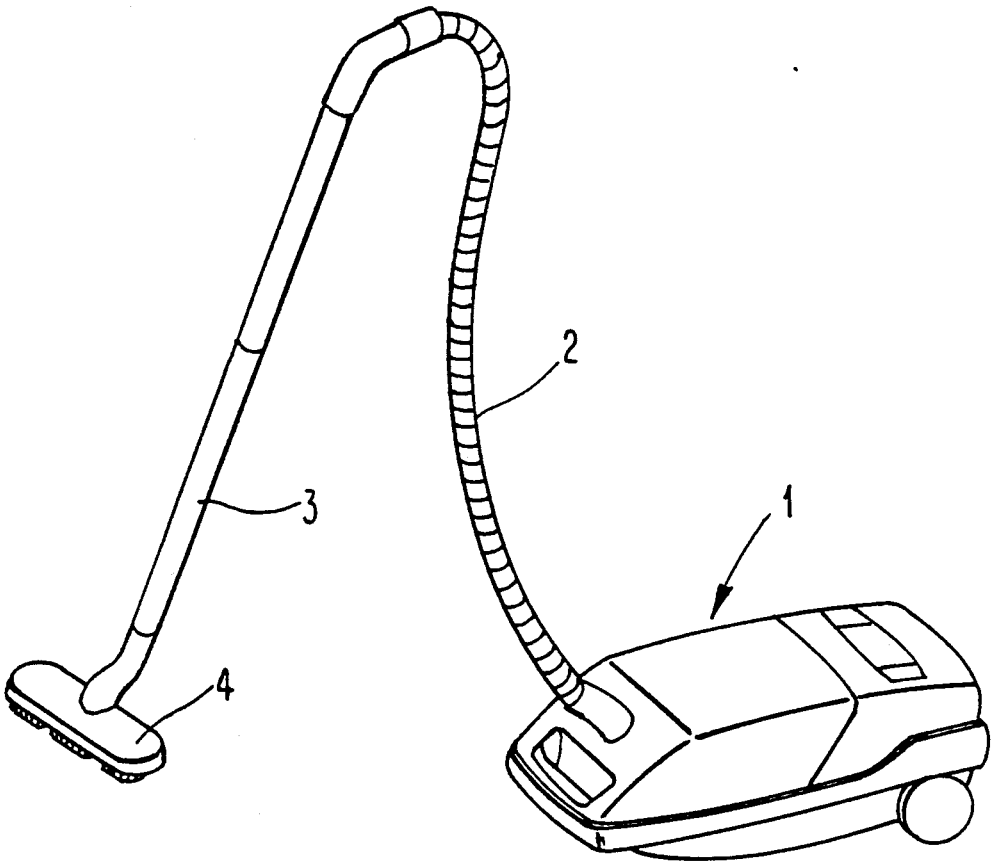
FIG. 1 is a perspective entire view showing a vacuum cleaner according to the present invention.

Referring to FIG. 1, the vacuum cleaner includes a body 1, a flexible hose 2, an extension wand 3 and a suction head 4. The body 1 contains a dust bag and a power-driven fan.

Figure 2:
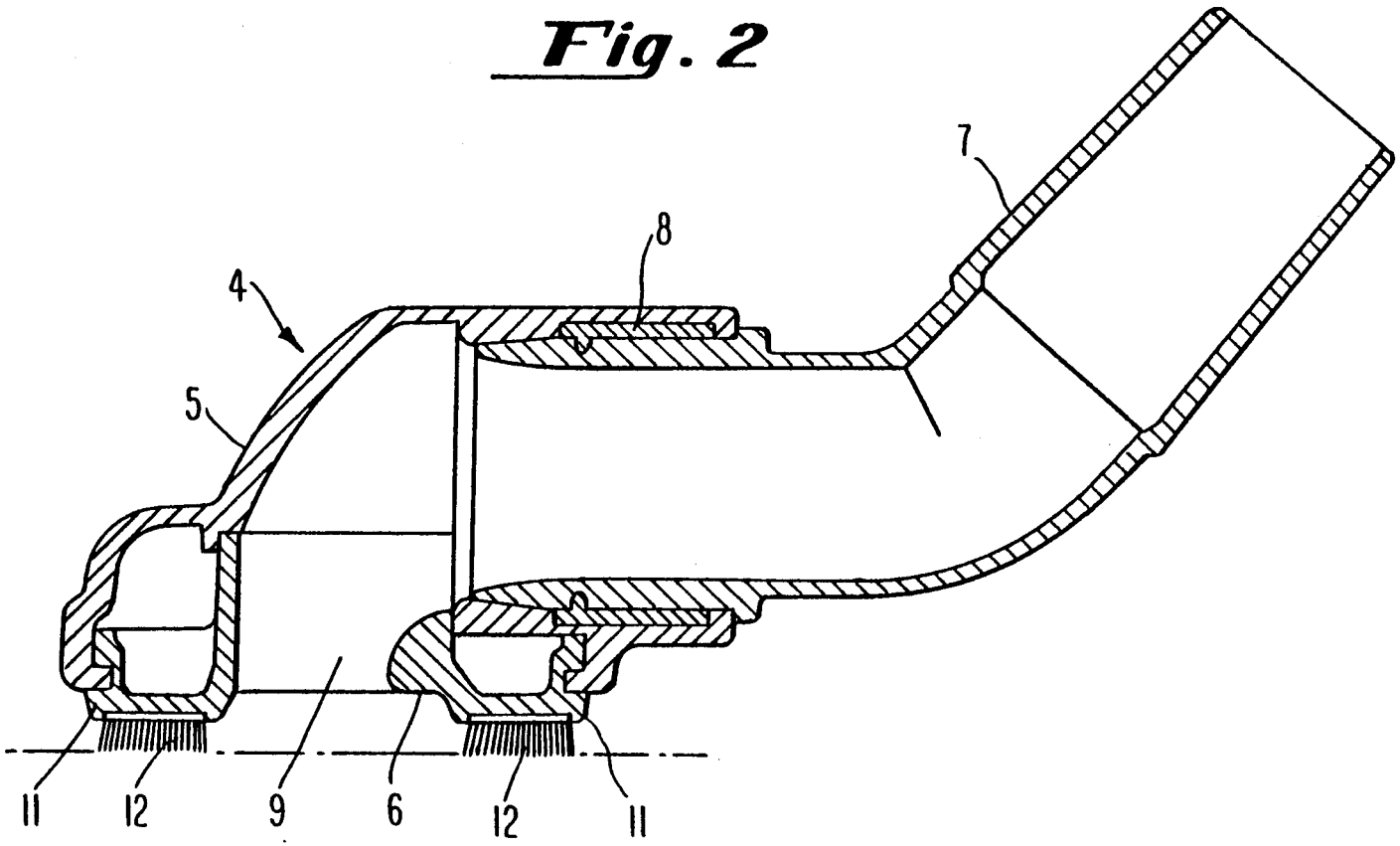
FIG. 2 is a cross-sectional view through the suction head of the vacuum cleaner of FIG. 1.
Figure 3:
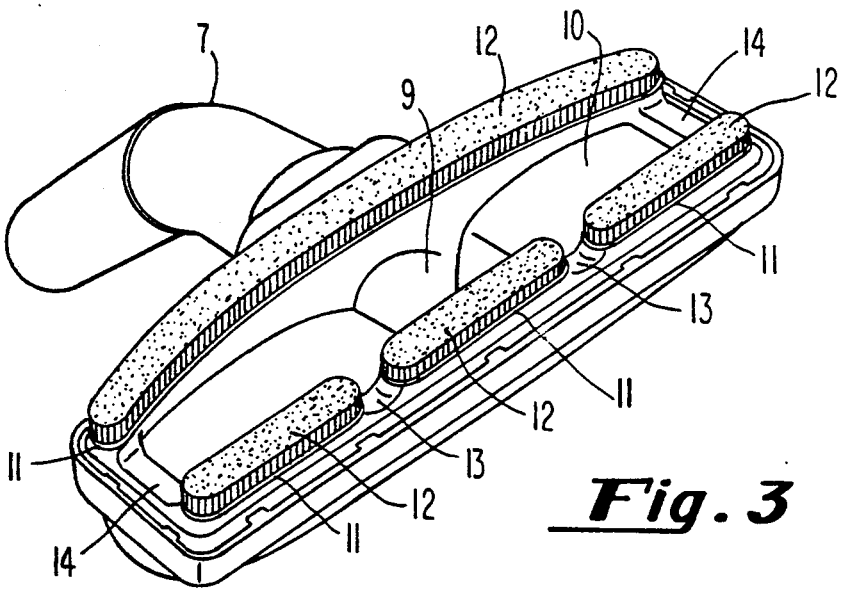
FIG. 3 is a perspective bottom view showing the suction head shown in FIG. 1.
Figure 4:
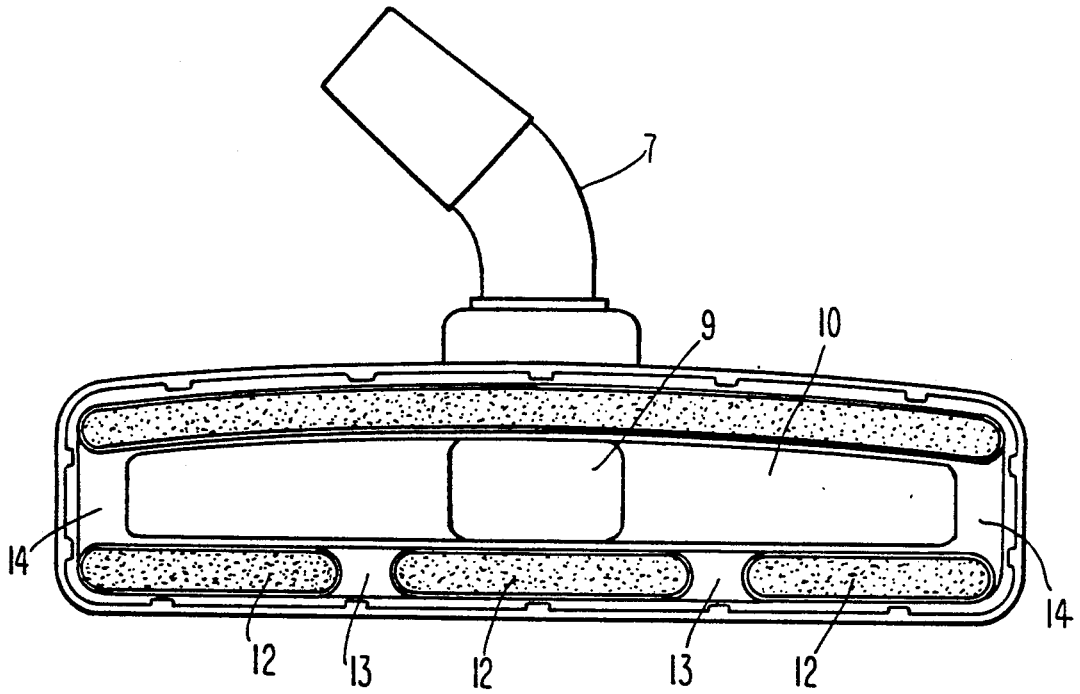
FIG. 4 is a rear view showing the suction head of FIG. 3.
Figure 5:
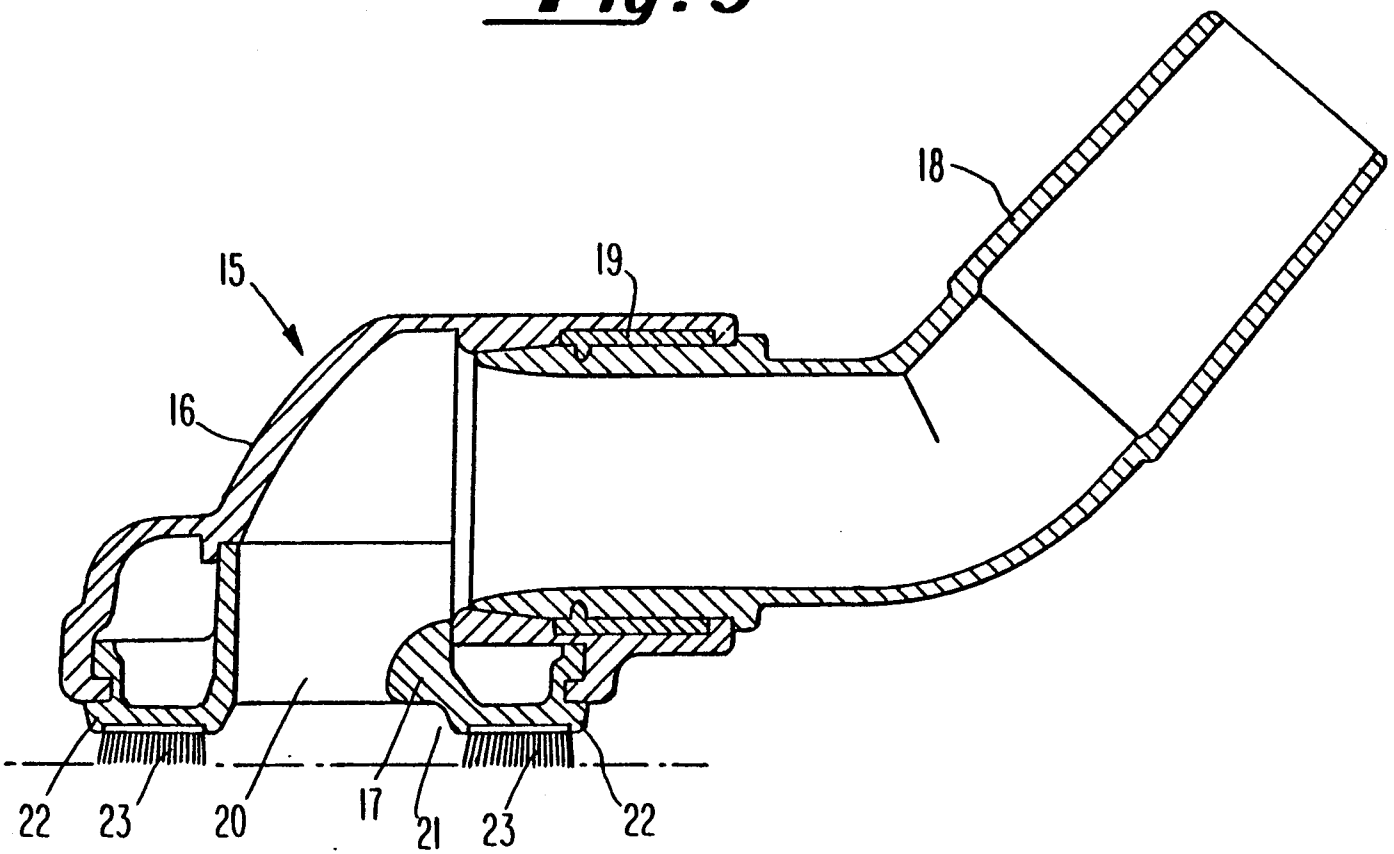
FIG. 5 is a cross-sectional view through the suction head of a modified version of the vacuum cleaner according to the present invention.
Figure 6:
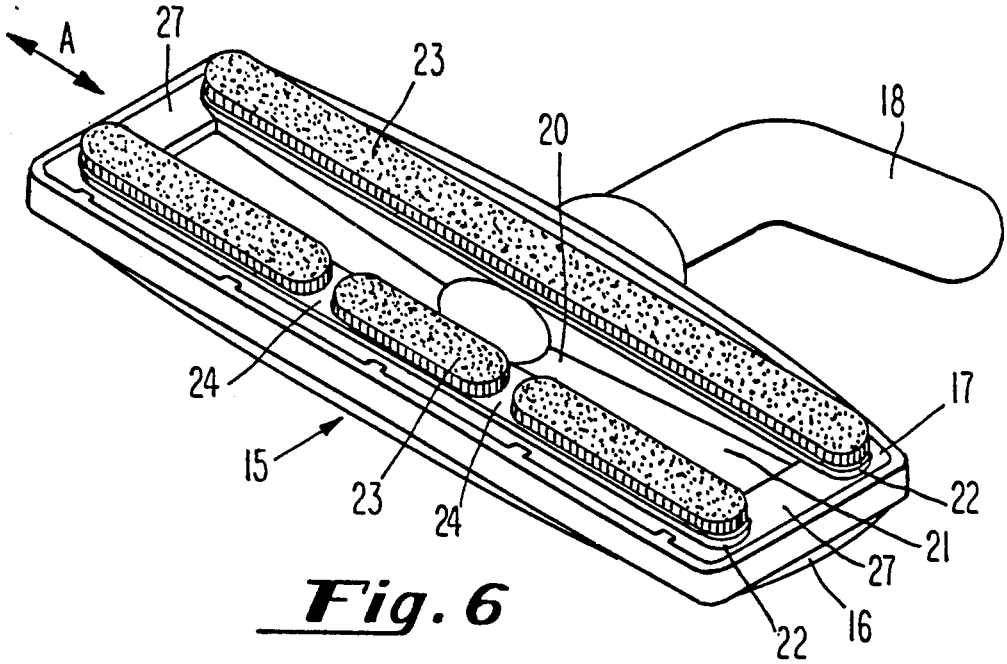
FIG. 6 is a perspective bottom view showing the suction head shown in FIG. 5.
Figure 7:
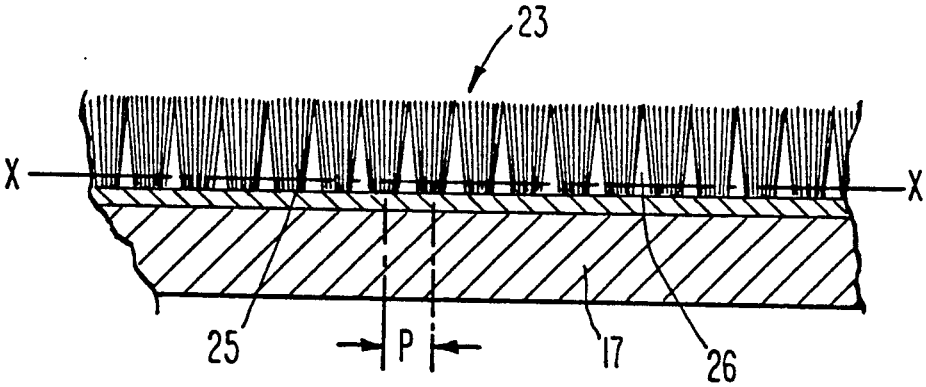
FIG. 7 is a fragmentary cross-sectional view showing the cut piles of the woven cloth shown in FIG. 5.
Figure 8:
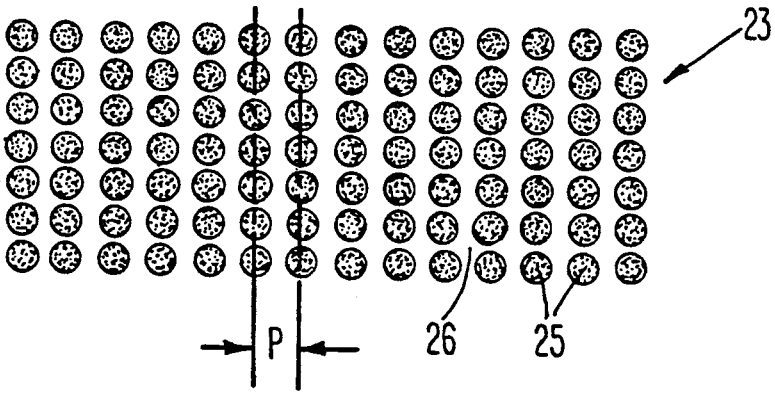
FIG. 8 is a cross-sectional view through the brush of FIG. 7.
Figure 9:
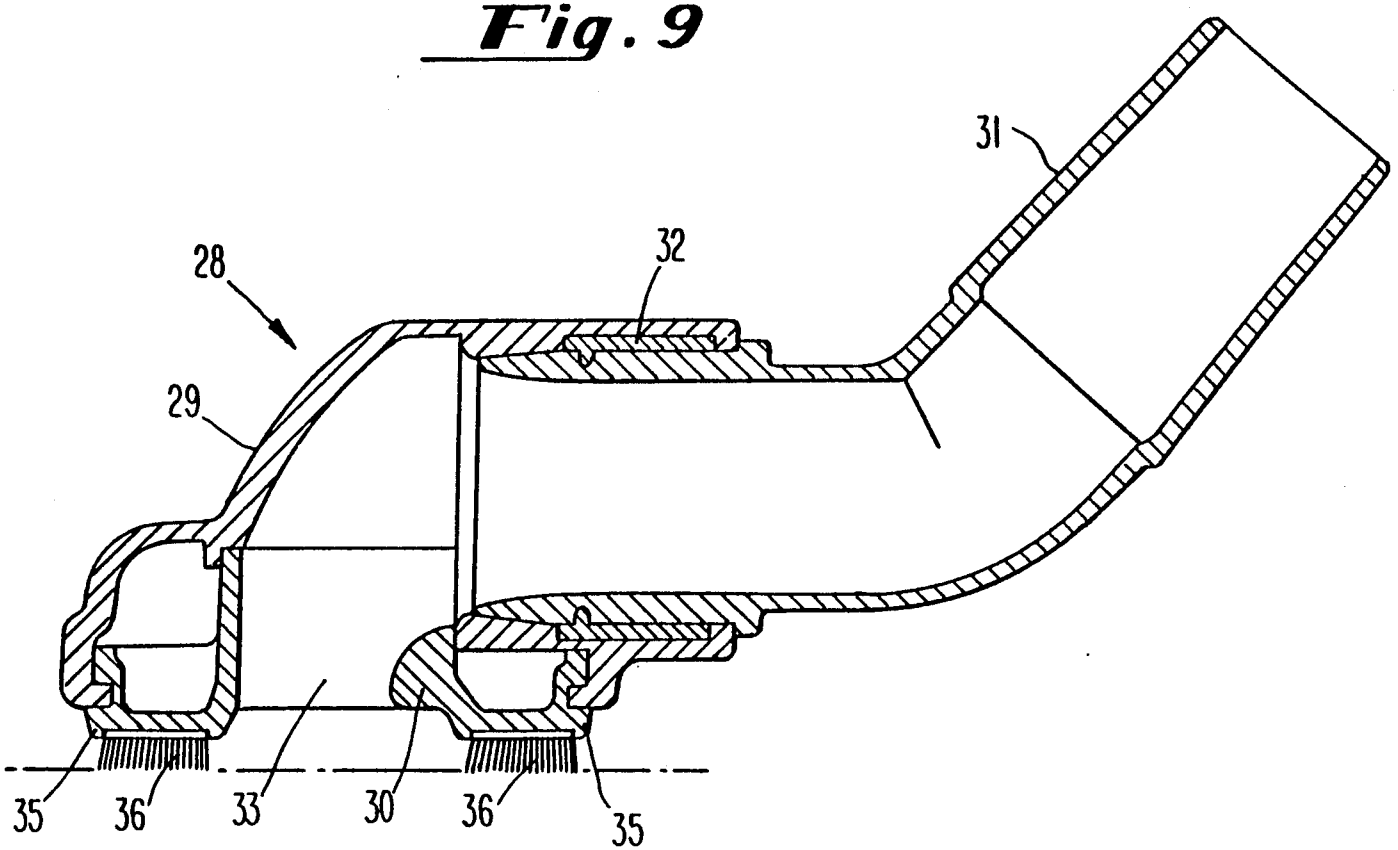
FIG. 9 is a cross-sectional view through the suction head of another modified version of the vacuum cleaner according to the present invention.
Figure 10:
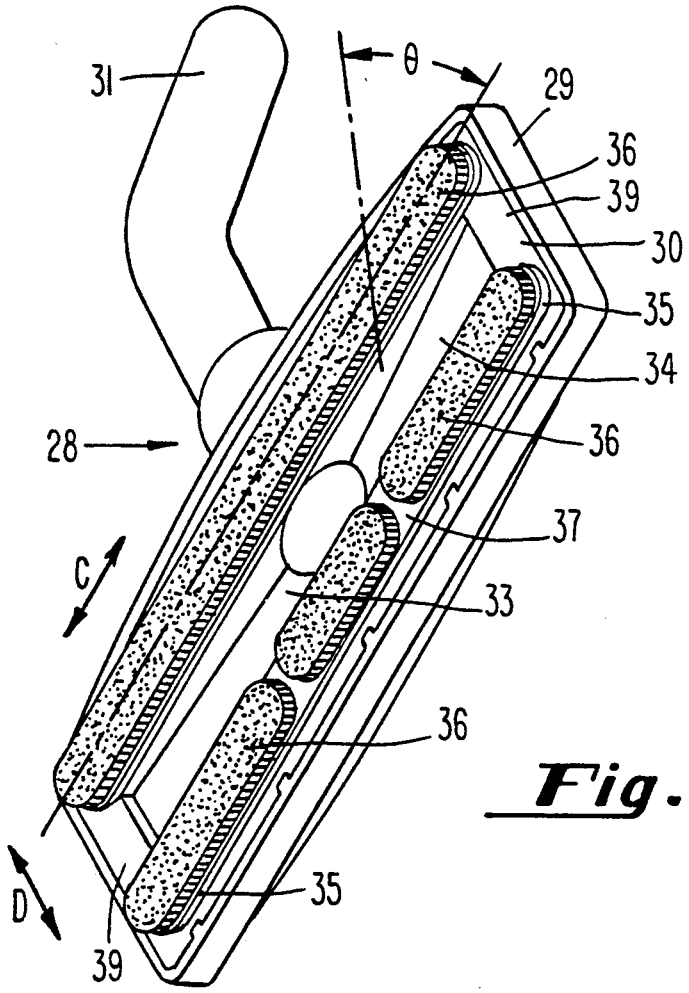
FIG. 10 is a perspective bottom view showing the suction head shown in FIG. 9.

Referring to FIGS. 2 to 4 the suction head 4 includes an upper portion 5 and a lower portion 6 which are detachably joined together. The upper portion 5 is joined to an extension pipe 7 by means of a ring 8, and the extension pipe 7 is rotatably connected to the body 1 through the extension wand 3 and the flexible hose 2. The suction head 4 is provided with a suction port 9 formed in the lower portion 6 for connection to the extension pipe 7, the suction port 9 including a groove extending in the left-hand and right-hand directions from the suction port 9. The groove 10 is surrounded by a ridge 11, and woven cloth 12 is mounted on the ridge 11 by adhesive so as to form a brush with its cut piles. For explanatory convenience the brush is divided into brush portions: in the illustrated embodiment, four brush portions are formed. The ridge 11 includes a front side and a rear side with respect to the suction port 9, that is, in the direction in which the suction head 4 is normally moved. The front side and the rear side of the ridge 11 will be referred to below. The woven cloth 12 has cut piles upright on its surface, each pile having a diameter of about 0.1 mm or less, so that the cut piles are densely upright on the bank 11. The length of each pile is about 4.0 to 6.0 mm so as to ensure that the suction port 9 is adequately spaced from the floor (or carpet) surface, thereby ensuring that the suction head 4 can smoothly and softly slide along the floor. The adequate space is required for preventing the suction head 4 from scratching the floor or damaging the carpet.

The front side of the ridge 11 is provided with recesses 13 formed between one brush portion and the next: in the illustrated embodiment two suction recesses 13 are provided but the number of the recesses is not limited, depending on the length of the ridge 11. The recesses 13 are intended to suck dirt in front of the suction head 4, and their depth is appropriately determined with respect to the height of the woven cloth 12 so as to adjust the suction efficiency. As shown in FIG. 3 the rear side of the ridge 11 is continuous with no breaks so that the air flow is controlled thereby ensuring that dirt on the floor (or carpet) is completely sucked into the suction head 4. The side recesses 14 are provided between the front side and the rear side of the ridge 11 so as to admit air into the suction head 4 at a high velocity through the groove 10 and the port 9. The suction efficiency can be adjusted by determining the size and the height of the side recesses 14. The end of each woven cloth 12 is rounded so as to enable air to enter the suction port 9 smoothly.

In operation, the extension pipe 7 of the suction head 4 is connected to the extension wand 3 of the body 1. Owing to the cut piles having lengths of 4.0 to 6.0 mm with respect to the floor (or carpet) surface, fine sand and other hard particles on the floor are advantageously trapped in the cut piles and stay there, thereby preventing them from scratching the floor surfaces or damaging carpets. In addition, owing to the presence of the recesses 13 and the side recesses 14, dirt located beyond the width of the suction head 4 is sucked into the recesses 13, 14, thereby enhancing the cleaning efficiency.

When the suction head 4 is applied to Japanese "tatami" mats, which are made out of straw and rush, the pressure imparted thereto by the suction head 4 is weakened by the effect of the cut piles, each of which is flexible so that the suction head 4 can smoothly slide along the "tatami" mats without abrading it. In addition, the tip portion of each bristle is inserted deeply in the fabric of the "tatami" mats so as to pick up deposits of dirt in the gaps between the woven straws.

Hard floor surfaces such as wooden floor are polished by the woven cloth 12 while the cleaning is carried out.

Referring to FIGS. 5 to 8, which illustrate a second example of the embodiment, the vacuum cleaner includes a body 1 (omitted) and a suction head 15 which is composed of an upper halved portion 16 and a lower halved portion 17 through an extension pipe 18. The upper halved portion 16 is detachably coupled to the extension pipe 18 by means of a ring 19. The suction head 15 is provided with a suction port 20 which communicates with the extension pipe 18 (and with the body 1). The suction port 20 includes a groove 21 extending in the left-hand and right-hand directions from the suction port 20. The groove 21 is surrounded by a ridge 22, and woven cloth 23 is mounted on the ridge 22 by adhesive so as to provide a brush portion. As described above, for explanatory convenience the brush is divided into brush portions: the illustrated embodiment has four brush portions. The woven cloth 23 has cut piles having a diameter of about 0.1 mm or less. The woven cloth 23 is mounted on the ridge 22 so that the cut piles are densely upright thereon. The length of each pile is not smaller than 4.0 mm so as to ensure the suction port 20 is adequately spaced from the floor (or carpet) surface thereby ensuring that the suction head 15 can smoothly and softly slide along the floor. The adequate space is required for preventing the suction head 15 from scratching the floor or damaging the carpet. The ridge 22 include a front side and a rear side with respect to the suction port 20, that is, in the direction in which the suction head 11 is normally moved. Brush portions 23 disposed on the front side of the ridge 22 are spaced by passages 24. The rear side of the ridge 22 is provided with a one-piece brush portion 23 with no break of a passage. There are provided side passages 27 between the brush portions on the front side and the rear side of the ridge 22. The difference between the recesses 13 and 14 in the first-mentioned example and the passages 24 and 27 in the second-mentioned example is that the passages 24 and 27 are produced on the flat surface of the ridge 22. The length of the cut piles of the cloth 23 is appropriately adjusted with respect to the passages 24 and 27, thereby enhancing the dust suction efficiency.

Excessively dense cut piles allow dirt to stay therein, thereby reducing the suction efficiency. To solve this problem, the root portions 25 of the cut piles are arranged with larger pitches in a direction (A) perpendicular to the air inducing direction than with those in the air inducing direction. This is clearly shown in FIG. 8. The reference numeral 26 denotes gaps between the adjacent root portions 25. The gaps 26 provide a relatively strong suction pressure to blow away dirt deposits in the cut piles. As described above with respect to the first-mentioned example, the width and height of the side passages 27 are adjusted to vary the dirt suction efficiency. The end of each brush portion 23 is rounded to enable air to enter the suction port 21 smoothly.

This example is operated in the same manner as the first-mentioned example.

Owing to the spaced root portions 25 of the cut piles arranged perpendicularly to the air inducing direction, a relatively strong suction pressure is produced through the gaps 26 whereby the dirt deposits in the cut piles are separated therefrom and induced into the suction port 20. As a result, the cut piles are kept clean and sanitary.

Referring to FIGS. 9 to 12, a third example of the embodiment will be described:

The illustrated vacuum cleaner includes a body 1 (omitted) and a suction head 28 which includes an upper portion 29 and a lower halved portion 30. The suction head 28 is connected to the body 1 (omitted) through a connection pipe 31 which is rotatably coupled to the upper portion 29 by means of a ring 32. The suction head 4 is provided with a suction port 33 formed in the lower portion 30 for connection to the extension pipe 31. The suction port 9 includes a groove 34 extending in the left-hand and right-hand directions therefrom.

The groove 34 is surrounded by a ridge 35, and woven cloth 36 is mounted on the ridge 35 by adhesion so as to provide a brush portion. For explanatory convenience the brush is divided into brush portions: in the illustrated embodiment, four brush portions are formed. The ridge 35 includes a front side and a rear side in the direction in which the suction head 28 is normally moved. ridge and the backward side The woven cloth 36 has cut piles having a diameter of about 0.1 mm or less. The length of each pile is not smaller than 4.0 mm so as to ensure that the suction port 33 is adequately spaced from the floor (or carpet) surface, thereby ensuring that the suction head 28 can smoothly and softly side along the floor. The adequate space is required for preventing the suction head 28 from scratching the floor or damaging the carpet.

Figure 11:
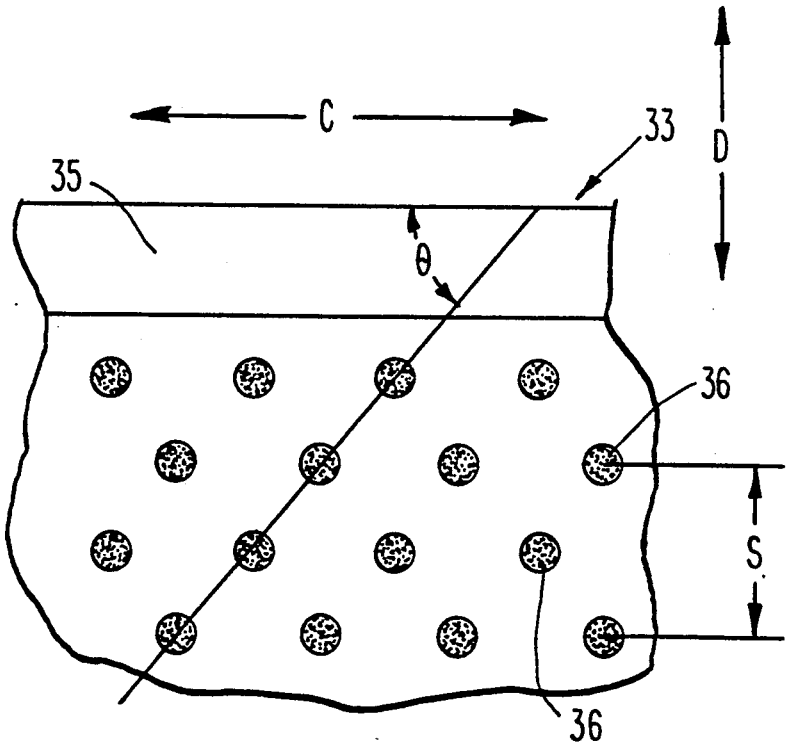
FIG. 11 is a diagrammatic plan view showing the arrangement of cut piles of the woven cloth shown in FIG. 10.
Figures 12, 13:
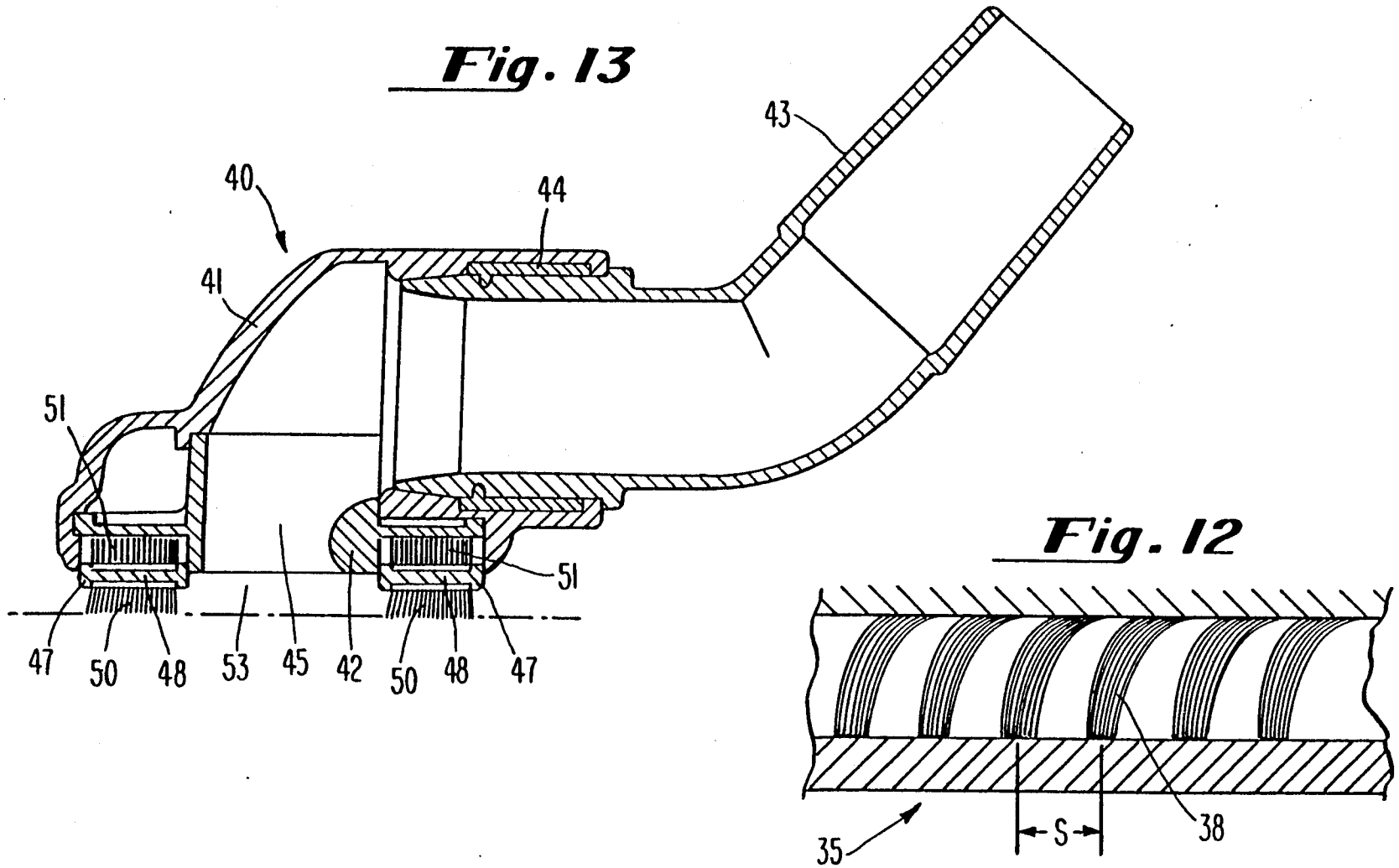
FIG. 12 is a fragmentary cross-sectional view showing a portion of the brush shown in FIG. 10.
FIG. 13 is a cross-sectional view through the suction head of a further modified version of the vacuum cleaner according to the present invention.

The cut piles 36 are bundled at their root portions 38, which, as shown in FIG. 11, are angled at an angle $\theta$ to the lengthwise width (C) of the lower portion 30 of the suction head 28. In addition, root portions 38 are aligned at distances (S) in the direction (D) in which air is sucked into the suction head 28, wherein the distance (S) is set sufficiently large to prevent the top portions of the cut piles 36 from overlapping each other when they are bent against the floor (or carpet). FIG. 12 shows that the top portions of the cut piles 36 are kept safe from overlapping each other.

The brush portion on the rear side of the ridge 35 is straight extending along it so as to block the air escaping from the groove 34 in a direction away from the suction port 33. If the escaping air flows in the direction in which air is sucked, the suction efficiency decreases. There are provided side passages 39 between the brush portions on the rear side and the front side of the ridge 35. The brush portions on the front side of the ridge 35 are spaced by passages 37.

The length of the cut piles are appropriately adjusted with respect to the passages 39 and 37, thereby enhancing the dust suction efficiency. The end of each brush portion is rounded so as to secure a smooth flow entering the groove 34.

Owing to the decrease in the number of cut piles 36 to the direction (C) the top portions of the cut piles 36 are prevented from overlapping each other.

Figure 14:
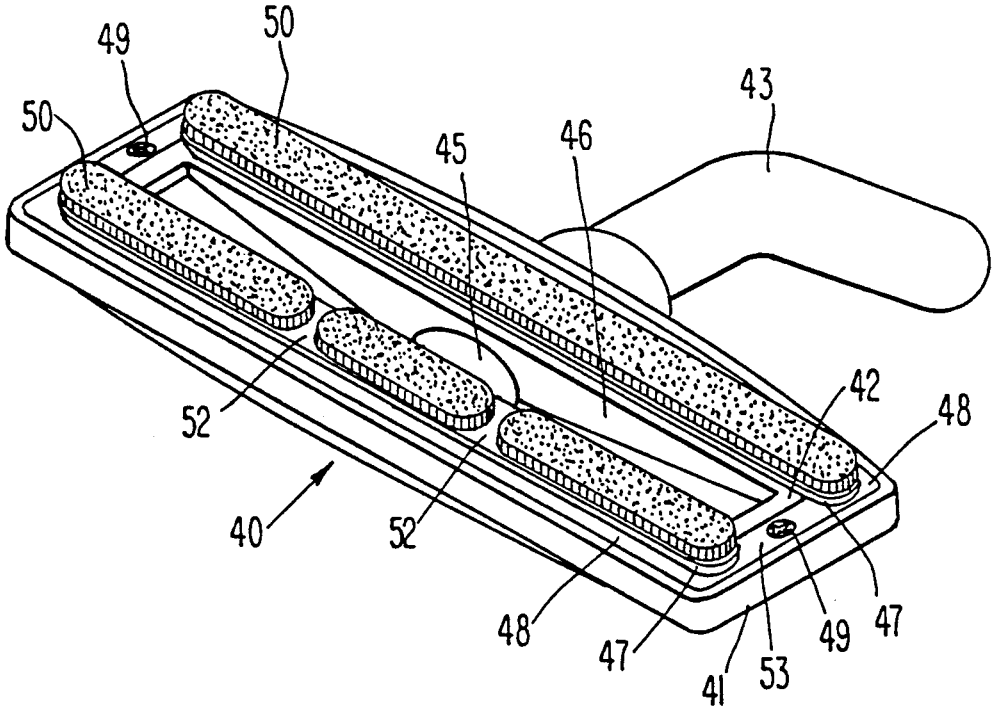
FIG. 14 is a perspective bottom view showing the suction head shown in FIG. 13.

Referring to FIGS. 13 to 14, a fourth example of the embodiment will be described:

The illustrated vacuum cleaner includes a body 1 (omitted) and a suction head 40 which includes an upper portion 41 and a lower halved portion 42. The suction head 40 is connected to the body 1 through a connection pipe 43 which is rotatably coupled to the upper portion 41 by means of a ring 44. The suction head 40 is provided with a suction port 45 formed in the lower portion 42 for connection to the connection pipe 43. The suction port 45 includes groove 46 extending in the left-hand and right-hand directions therefrom.

The groove 46 is surrounded by a frame-like seat 48 constituting a ridge 47, which is joined to the lower portion 42 by means of screws 49. Initial use woven cloth 50 is mounted on the ridge 47 by adhesive so as to provide an initial use brush portion. A second use woven cloth 51 is mounted on another side of the ridge 47. The woven cloth 50 and 51 provide brush portions, which are also divided into four portions. The ridge 47 includes a front side and a rear side in the direction in which the suction head 40 is normally moved on the floor (or carpet). As described above, the ridge 47 include the rear side and the rear side. The woven cloth 50 and 51 have cut piles having a diameter of about 0.1 mm or less, so that they are densely upright on the ridge 47. The length of each pile is not smaller than 4.0 mm so as to ensure that the suction port 45 is adequately spaced from the floor (or carpet) surface thereby ensuring that the suction head 40 can smoothly and softly slide along the floor. The adequate space is required for preventing the suction head 40 from scratching the floor or damaging the carpet.

The brush portions formed by the woven cloth 50 and 51 on the front side of the ridge 47 are spaced by passages 52. The size of the passages 52 is appropriately adjusted with respect to the height of the cut piles of woven cloth 50 and 51 so as to secure an optimum suction efficiency. The brush portions formed by the woven cloth 50 and 51 on the rear side of the ridge 47 extend along it with no break. The reference numeral 53 denotes side passages between the brush portions on the front side and the rear side of the ridge 47.

The brush portion on the rear side of the ridge 47 is straight extending along it so as to block the air escaping from the side passages 53. If any air escapes in the direction in which air is sucked, the suction efficiency decreases. Side passages 53 are provided between the brush portions on the rear side and the front side of the ridge 47. The end of each brush portion is rounded so as to secure a smooth flow entering the groove 46.

In effecting the changeover between the woven cloth 50 and 51, the screws 49 are unfastened and the seat 48 is reversed and fastened to the lower portion of the suction head 42.

Figures 15, 16:
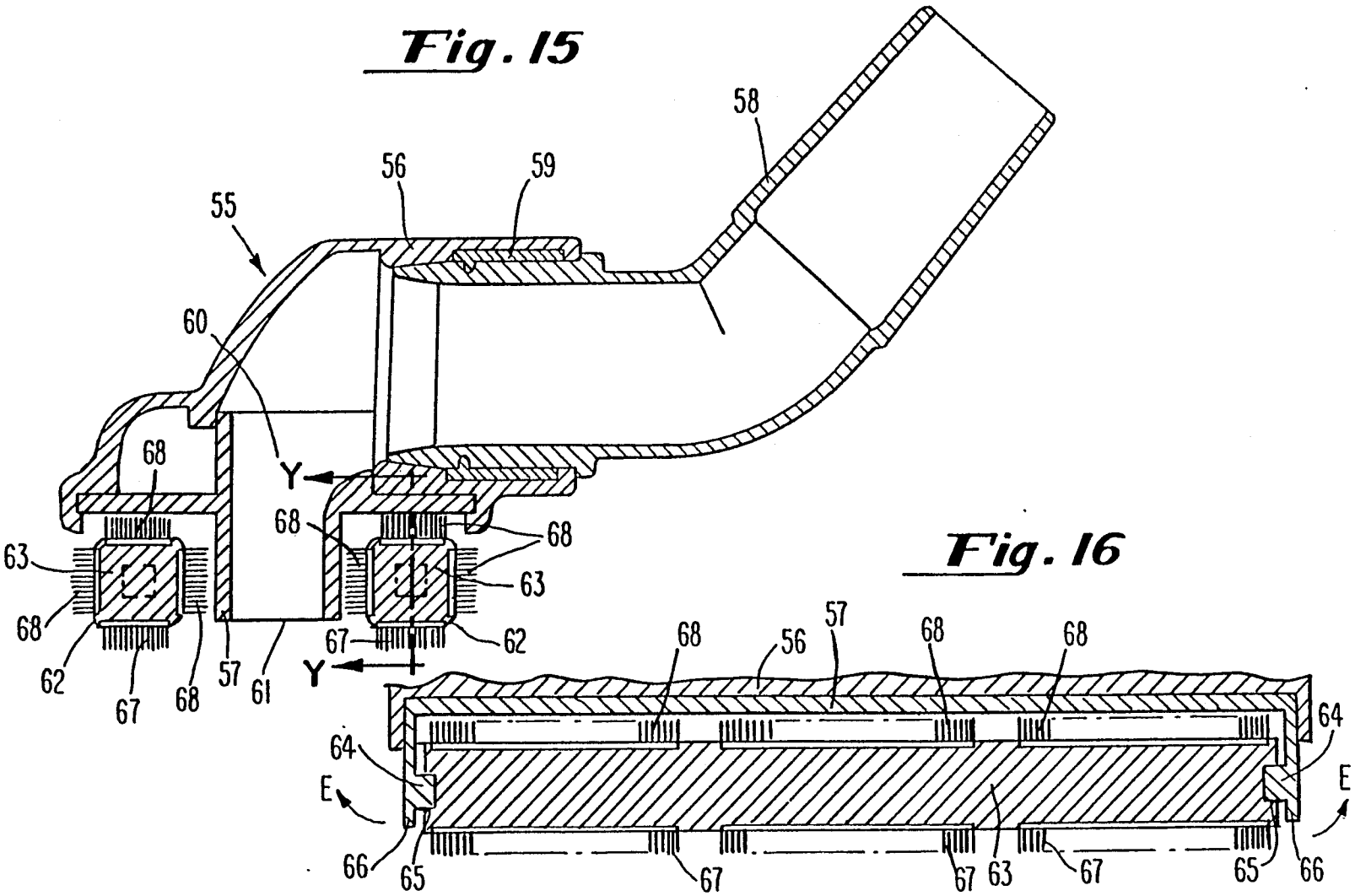
FIG. 15 is a cross-sectional view taken the suction head of another modified version of the vacuum cleaner according to the present invention.
FIG. 16 is a cross-sectional view taken along the line Y—Y in FIG. 15.

Referring to FIGS. 15 and 16, a fifth example of the embodiment will be described:

The illustrated vacuum cleaner includes a body 1 (omitted) and a suction head 55 which includes an upper portion 56 and a lower halved portion 57. The suction head 40 is connected to the body 1 through a connection pipe 58 which is rotatably coupled to the upper halved portion 56 by means of a ring 59. The suction head 55 is provided with a suction port 60 formed in the lower portion 57 for connection to the connection pipe 58. The suction port 60 includes groove 61 extending in the left-hand and right-hand directions therefrom.

The groove 61 is surrounded by a pair of polygonal seats 63 constituting a ridge 62 on a front side and a rear side of the lower portion 57 in the direction in which the suction head 55 is normally moved on the floor (or carpet). The polygonal seat 63 is secured to each side of the lower portion 57 by engaging projections 64 of ledges 66 of the lower portion 57 with recesses 65 of the polygonal seat 63. The ledges 66 are flexible so as to facilitate the engagement and disengagement of the projections 64 with the recesses 65. Initial use woven cloth 67 is mounted on one of the sides of the ridge 47 by adhesive so as to provide an initial use brush as a whole. Second use woven cloth 68 is mounted on the other three sides of the ridge 62 by adhesive. The woven cloth 67 and 68 have cut piles having a diameter of 0.1 mm or less. As described above, the ridge 47 include the front side and the rear side. The cut piles are densely upright on the ridge 47 through the respective cloth. The length of each pile is not smaller than 4.0 mm so as to ensure the suction port 45 is adequately spaced from the floor (or carpet) surface, thereby ensuring that the suction head 28 can smoothly and softly slide along the floor. The adequate space is required for preventing the suction head 40 from damaging the floor or the carpet.

The initial use woven cloth 67 has cut piles each having a diameter of not larger than 0.1 mm and a length of not smaller than 4.0 mm so as not to lose soft touch on the cleaning object. The cut piles are upright on the ridge 47 through the cloth 67.

In operation, the initial use woven cloth 67 is initially used but because of their fine structure the initial use woven cloth 67 wear out in a relatively short period of time. To replace a fresh brush portion the projections 64 are disengaged from the recesses 65 by pulling the ledges 66 in t he direction of arrow (E) and the polygonal seat 63 is rotated at 90° so that a fresh brush portion comes out in the lower portion 57. The polygonal seat 63 is again secured to the lower portion 57 by returning the ledges into the recesses 65 in the opposite direction to the direction (E). In this way the second use woven cloth 68 is used in turn until all of them wear out. When the number of the polygonal sides are increased, the total life of the brush is prolonged; that is, it is multiplied by the number of the polygonal sides. In the illustrated embodiment the life of the brush will be multiplied by 4.

Figure 17:
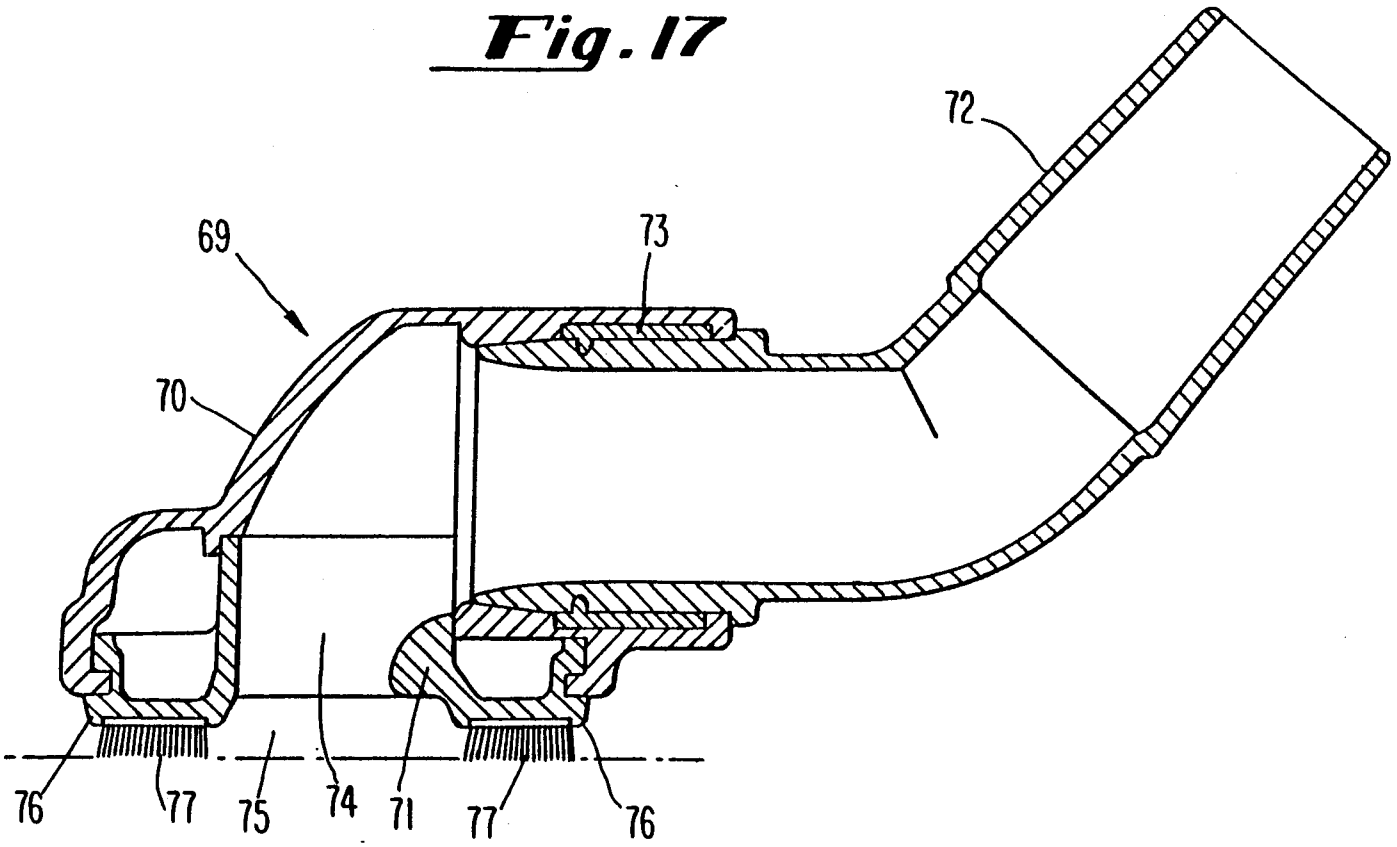
FIG. 17 is a cross-sectional view through the suction head of another modified version of the vacuum cleaner according to the present invention.
Figure 18:
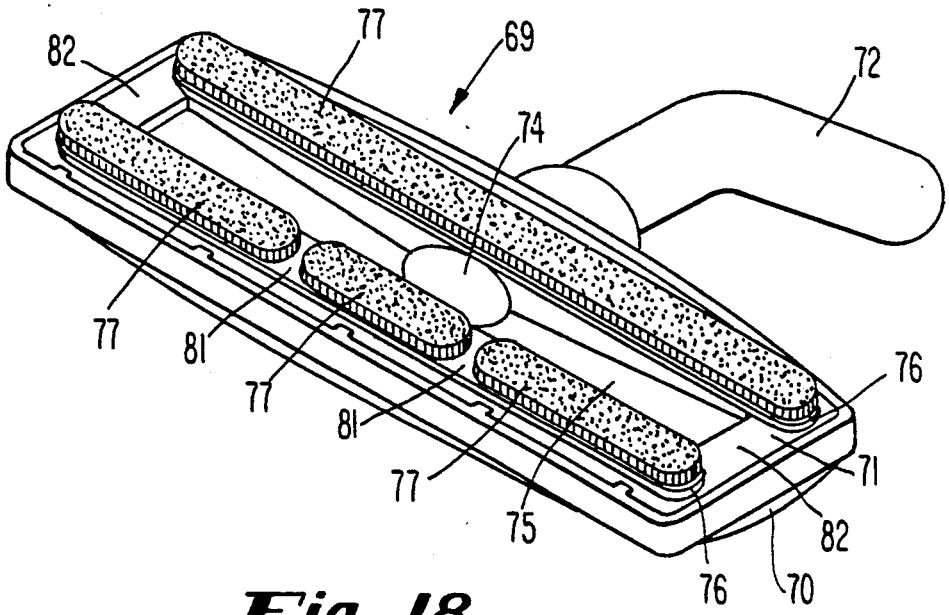
FIG. 18 is a perspective rear view showing the suction head of FIG. 17.
Figure 19:
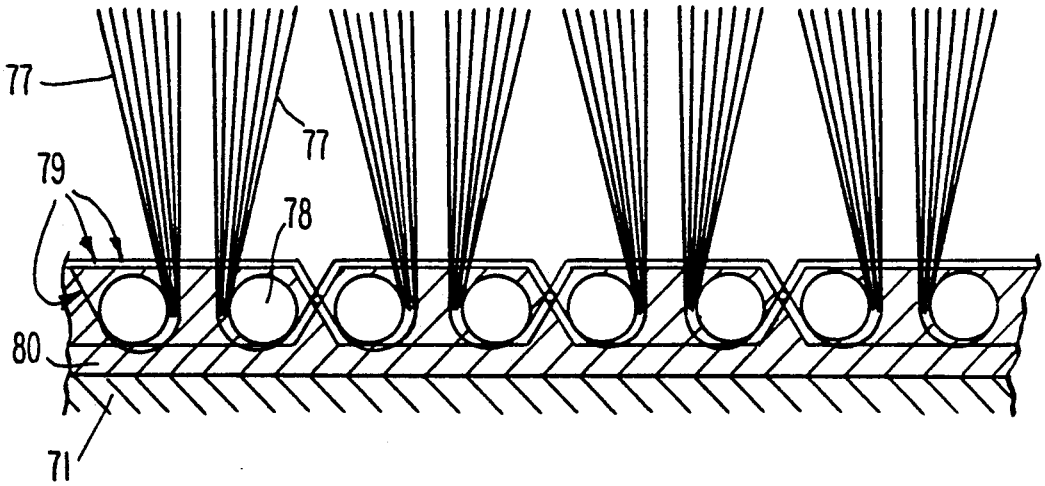
FIG. 19 is a cross-sectional view through the suction head of a further modified version of the vacuum cleaner according to the present invention.
Figure 20:
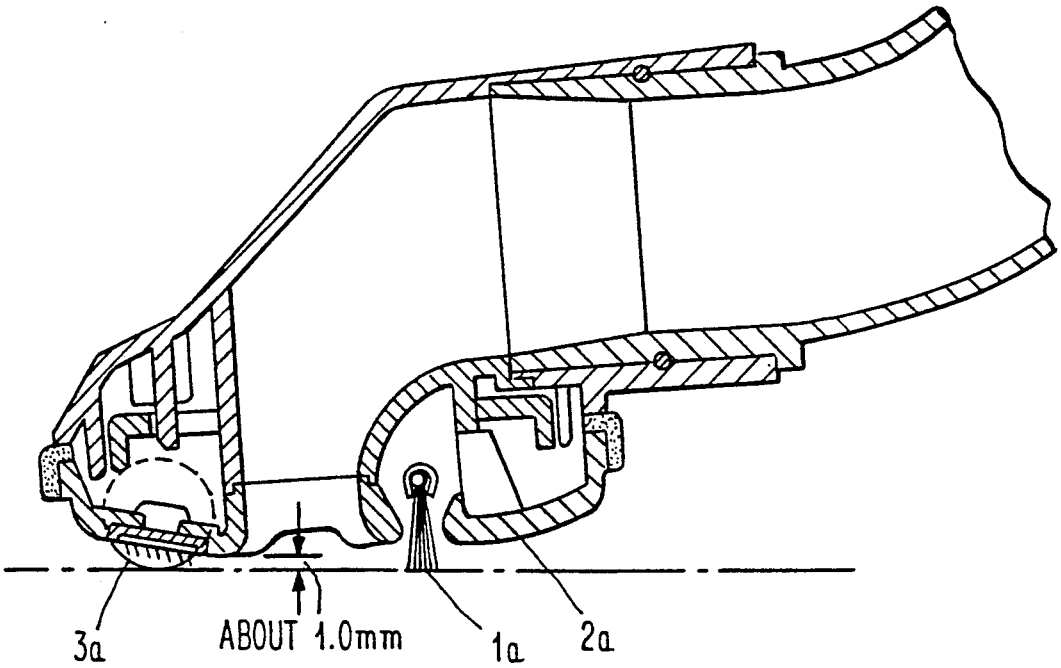
FIG. 20 is a cross-sectional view through a known suction head.
Figure 21:
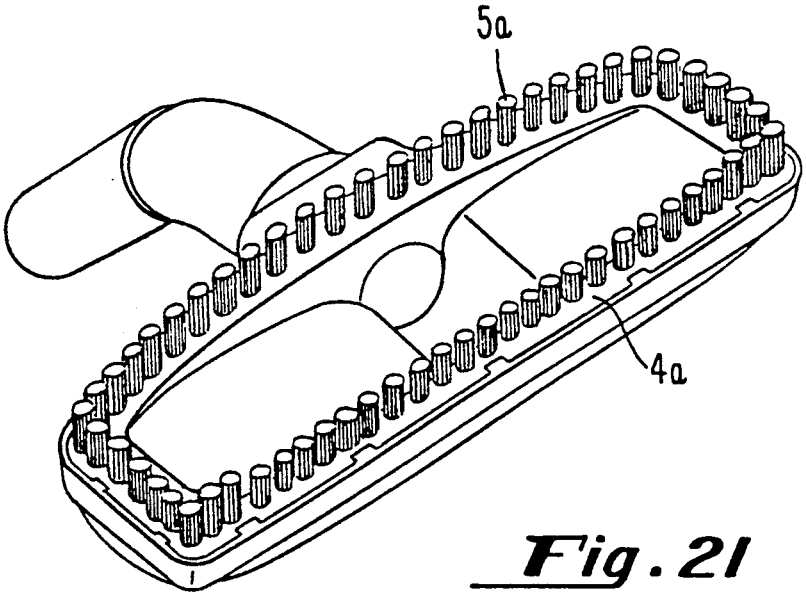
FIG. 21 is perspective rear view showing a known suction head of another type.

Referring to FIGS. 17 to 19, a sixth and a seventh example of the embodiment will be described:

The illustrated vacuum cleaner includes a body 1 (omitted) and a suction head 69 which includes an upper portion 70 and a lower halved portion 71. The suction head 40 is connected to the body 1 through a connection pipe 72 which is rotatably coupled to the upper portion 56 by means of a ring 73. The suction head 55 is provided with a suction port 74 formed in the lower portion 71 for connection to the connection pipe 72. The suction port 60 includes groove 75 extending in the left-hand and right-hand directions therefrom.

The groove 75 is surrounded by a ridge 76, and woven cloth 77 is mounted on the ridge 76 by adhesive so as to provide a brush as a whole. The woven cloth 77 has cut piles having a diameter of about 0.1 mm or less, so that the cut piles can densely upright on the ridge 76. The napping cloth is a cloth woven with warp and weft. The length of each pile is not smaller than 4.0 mm so as to ensure the suction port 60 is adequately spaced from the floor (or carpet) surface, thereby ensuring that the suction head 69 can smoothly and softly slide along the floor. The adequate space is required for preventing the suction head 69 from scratching the floor or damaging the carpet.

As shown in FIG. 19, the napping cloth 77 is treated with moth proofing and/or sterilizing treatment. To achieve these treatments, the base cloth is made by weaving weft 78 and warp 79, both of which have an affinity with a moth proofing agent and a sterilizing agent, and these threads are lined with a back-up material 80 of adhesive.

The brush portions on the front side of the ridge 76 are spaced by passages 81 which enable air to enter the suction head 69. The size of the passages 81 is adjusted with respect to the height of the cut piles of the woven cloth 77 so as to adjust the suction efficiency. The rear side of the ridge 76 is continuous with no breaks so as not to allow any air to leak in the direction opposite the suction port, thereby ensuring that dirt on the floor (or carpet) is completely sucked into the suction head 69. There are provided side passages 82 between brush portions on the front side and the rear side of the ridge 76 so as to admit air into the suction head 69 at a high velocity through the groove 10 and the suction port 9. The suction efficiency can be adjusted by determining the size and the height of the side passages 82. The end of each brush portion 77 is rounded so as to enable air to enter the suction port 75 smoothly.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A suction head for attachment to a vacuum cleaner, the suction head comprising a suction port including a brush supporting ridge on its periphery, the brush supporting ridge including a front side and a rear side with respect to the suction port a brush of cut piles of woven cloth disposed on the brush supporting ridge, wherein a first segment of the brush mounted on the front side of the brush supporting ridge comprises a plurality of brush portions spaced from each other by air passages, and the first segment of the brush on the front side of the brush supporting ridge and a second segment of the brush mounted on the rear side of the brush supporting ridge are spaced from each other by air passages extending perpendicularly to the direction in which air is induced into the suction head.

2. A suction head according to claim 1, wherein the bank is disposed on an forward side and a backward side of the suction port, the woven cloth is disposed on each side of the suction port, wherein the brush on the forward side of the suction port comprises a plurality of portions spaced by a first air passage, and the brush portions on the forward side and the backward side of the suction port are spaced by a second air passage extending perpendicularly to an direction in which air is induced into the suction head.

* * * * *